US006786585B2

(12) United States Patent
Shingai et al.

(10) Patent No.: US 6,786,585 B2
(45) Date of Patent: Sep. 7, 2004

(54) INKJET HEAD

(75) Inventors: Tomohisa Shingai, Kawasaki (JP); Shuji Koike, Setagaya (JP); Yoshiaki Sakamoto, Kawasaki (JP)

(73) Assignee: Fuji Photo Film Co., Ltd., Minami-Ashigara (JP)

( * ) Notice: Subject to any disclaimer, the term of this patent is extended or adjusted under 35 U.S.C. 154(b) by 0 days.

(21) Appl. No.: 10/259,755

(22) Filed: Sep. 30, 2002

(65) Prior Publication Data

US 2003/0025769 A1 Feb. 6, 2003

Related U.S. Application Data

(63) Continuation of application No. PCT/JP00/02141, filed on Mar. 31, 2000.

(51) Int. Cl.[7] ..... B41J 2/17
(52) U.S. Cl. ..... 347/94
(58) Field of Search ..... 347/68, 70, 94, 347/56, 65

(56) References Cited

U.S. PATENT DOCUMENTS 4,443,807 A 4/1984 Koto
4,774,529 A * 9/1988 Paranjpe et al. ..... 347/43
5,943,079 A 8/1999 Yoshida

FOREIGN PATENT DOCUMENTS

| | | |
|---|---|---|
| JP | 57-91275 | 6/1982 |
| JP | 60-8074 | 1/1985 |
| JP | 63-17056 | 1/1988 |
| JP | 63-280650 | 11/1988 |
| JP | 3-202352 | 9/1991 |
| JP | 8-132639 | 5/1996 |
| JP | 9-141856 | 6/1997 |

* cited by examiner

*Primary Examiner*—Judy Nguyen
(74) *Attorney, Agent, or Firm*—Armstrong, Kratz, Quintos, Hanson & Brooks, LLP

(57) ABSTRACT

The ink replenishment frequency is increased in an inkjet head having nozzles for injecting ink. Independent dampers are provided in ink supply passages to impart an acoustic capacitance to the ink supply passages, and therefore a reciprocal action is generated between the pressure chambers and the ink supply passages, whereby the operation of ink replenishment can be stimulated. Accordingly, the ink replenishment frequency can be increased by a factor of approximately √3, without having to provide functional elements in the ink supply passage.

8 Claims, 15 Drawing Sheets

FIG. 16

| ITEM | | NUMERIC DATA |
|---|---|---|
| PIEZO ELECTRIC MEMBER | MATERIAL | PZT |
| | WIDTH (μm) | 100 |
| | LENGTH (μm) | 700 |
| | THICKNESS (μm) | 2 |
| | DENSITY (Kg/m$^3$) | 8600 |
| | YOUNG'S MODULUS (GPa) | 100 |
| | PIEZO ELECTRIC CONSTANT d31 (pm/V) | 100 |
| VIBRATING PLATE | MATERIAL | Cr |
| | WIDTH (μm) | 100 |
| | LENGTH (μm) | 700 |
| | THICKNESS (μm) | 1.5 |
| | DENSITY (Kg/m$^2$) | 7190 |
| | YOUNG'S MODULUS (GPa) | 248 |

FIG. 17

| ITEM | NUMERIC DATA |
|---|---|
| NOZZLE DIAMETER (μm) | 20 |
| NOZZLE STRAIGHT LENGTH (μm) | 5 |
| NOZZLE TAPER LENGTH (μm) | 35 |
| NOZZLE TAPER ANGLE (°) | 40 |
| INK SUPPLY PASSAGE1 WIDTH (μm) | 71 |
| INK SUPPLY PASSAGE1 LENGTH (μm) | 761 |
| INK SUPPLY PASSAGE1 DEPTH (μm) | 73 |
| INK SUPPLY PASSAGE2 WIDTH (μm) | 16 |
| INK SUPPLY PASSAGE2 LENGTH (μm) | 34 |
| INK SUPPLY PASSAGE2 DEPTH (μm) | 17 |
| PRESSURE CHAMBER WIDTH (μm) | 100 |
| PRESSURE CHAMBER LENGTH (μm) | 700 |
| PRESSURE CHAMBER DEPTH (μm) | 123 |
| PRESSURE CHAMBER WALL THICKNESS (μm) | 69.33 |
| PRESSURE CHAMBER MATERIAL | p1 |
| PRESSURE CHAMBER YOUNG'S MODULUS (GPa) | 8 |
| APPLIED VOLTAGE (V) | 10.0 |
| INK PARTICLE VOLUME (pl) | 2.0 |
| INK PARTICLE FLYING SPEED (m/s) | 8.0 |

INDIVIDUAL DAMPER

| | |
|---|---|
| WIDTH (μm) | 100 |
| LENGTH (μm) | 268 |
| THICKNESS (μm) | 3.5 |
| MATERIAL | POLYIMIDE |
| YOUNG'S MODULUS (GPa) | 8 |

| ITEM | NUMERIC DATA |
|---|---|
| KIND | WATER-BASED INK |
| INK VISCOSITY (cP) | 2.6 |
| SURFACE TENSION (N/m) | 0.0333 |
| SONIC VELOCITY (m/s) | 1540 |
| DENSITY (Kg/m$^3$) | 1018 |

INKJET HEAD

This application is a continuation of international application PCT/JP00/02141, filed on Mar. 31, 2000.

BACKGROUND OF THE INVENTION

1. Field of the Invention

The present invention relates to an inkjet head for jetting ink by applying pressure to a pressure chamber, and more particularly, to an inkjet head for improving the speed of ink replenishment into the pressure chamber.

2. Description of the Related Art

Inkjet heads perform recording by jetting ink drops onto a recording medium, and are widely used in small-scale printers. FIG. 21 and FIG. 22 are compositional diagrams of a conventional inkjet head. This head 10 is an example wherein a bimorph actuator is adopted, comprising a piezoelectric element 101 layered on a vibrating plate 102 to form a driving element.

In this head 10, ink is supplied to the head 10 from an ink tank 108, and moreover, inside the head 10, ink is supplied to respective pressure chambers 104 and nozzles 106 by means of a common ink passage 107 and ink supply passages 110.

When a drive signal from a drive circuit is supplied to the individual electrode 100 on the piezoelectric element 101 (there being one electrode corresponding to each nozzle), the vibrating plate 102 is caused to distort towards the inside of the pressure chamber 104, by the piezoelectric effect of the piezoelectric element 101, thereby causing ink to be expelled from the nozzle 106. This ink forms a dot on the printing medium, whereby a desired image is created.

In this way, in a multi-nozzle head 10, each pressure chamber 104 is connected to the common ink passage (chamber) 107 by means of respective ink supply passages 110, and ink is supplied to each pressure chamber 104 from the common ink passage 107. Therefore, after ink has been expelled from the nozzle 106, ink is replenished from the common ink chamber 107 to the pressure chamber 104, via the ink supply passage 110. An acoustic capacitor section 109 is provided in the common ink passage 107, in order to absorb and alleviate pressure fluctuations in the respective pressure chambers 104.

An acoustic equivalent circuit of the head 2 having this composition is illustrated in FIG. 23. It can be approximated to the equivalent circuit shown in FIG. 24 when ink is expelled, and to the equivalent circuit shown in FIG. 25 when ink is being replenished. In other words, when jetting ink, an acoustic capacitance C2 of the piezoelectric element 101 and the pressure chamber 104 is added to the circuit, because the pressure chamber 104 is operated by the piezoelectric element 101. While, the process of replenishing ink is expressed by an LCR second-order delay system comprising the acoustic resistance R1 and inductance L1 between the nozzle 106 and supply passage 110, and the acoustic capacitance of the meniscus of the nozzle.

Since the acoustic capacitance of the meniscus, c1, is an order of 10 greater than the acoustic capacitance between the piezoelectric element and pressure chamber, the intrinsic frequency of the ink emission is several 10 to 100 and several 10 KHZ, which permits high-speed operation in the 10 microsecond order, whereas the intrinsic frequency of the replenishment of the injected ink is several to several 10 KHz, which allows 100 microsecond-order operation. Therefore, the operating frequency of the inkjet head is limited by the replenishment frequency, and hence it is difficult to increase the operating frequency beyond several 10 KHz.

This situation is made evident by the frequency characteristics of the charge flow in the approximate equivalent circuit of FIG. 25, which are illustrated in FIG. 26. More specifically, taking ω0 as the intrinsic frequency of the LCR second-order delay in FIG. 25, ω/ω0 is plotted on the horizontal axis, and the normalized charge flow is illustrated on the vertical axis. In the case of an inkjet head, the charge flow corresponds to the volume displacement of the ink. The parameter damping factor, δ, is expressed by the following equation.

$$\delta=0.5*(Rn+Rc+Rs)*\sqrt{(Cn/(Ln+Lc+Ls))}$$

Consequently, at a damping factor of δ=0.5, which is the normal optimum value, if ω/ω0 exceeds "1", then the charge flow declines sharply, in other words, the ink volume displacement reduces, and therefore, using the head at a frequency at or above the intrinsic frequency ω0 will lead to ink supply shortage, and hence the volume of ink injected will decrease sharply. For example, in the case of a fabricated head having nozzle diameter of 20 microns, which injects 2.0 pl ink particles, the intrinsic frequency of the ink emission will be 111.9 KHZ, whereas the intrinsic frequency of the ink replenishment will be 34.5 KHz, this latter intrinsic frequency being some 3.2 times greater than the emission frequency. This means that it is difficult to perform high-speed printing which makes full use of the ink emission capacity. Moreover, when performing high-speed printing, it is necessary to increase the number of nozzles for injecting ink (for example, to several hundred or more), and this leads to increased device costs.

SUMMARY OF THE INVENTION

It is an object of the present invention to provide an inkjet head for enabling high-speed printing, by increasing the operating frequency of ink replenishment.

It is a further object of the present invention to provide an inkjet head for achieving high-speed printing in an inexpensive manner, by increasing ink replenishment speed, without using costly functional elements, and the like.

It is yet a further object of the present invention to provide an inkjet head for increasing the operating frequency of ink replenishment by means of a simple composition.

In order to achieve these objects, the inkjet head according to the present invention comprises: pressure chambers communicating with the nozzles; energy generating sections for imparting ink injection energy to the pressure chambers; and supply passages for supplying ink from an ink chamber to the pressure chambers; each of the supply passages comprising: an independent damper; a first ink supply passage connecting the independent damper with the pressure chamber; and a second ink supply passage connecting the independent damper with the ink chamber.

In the present invention, the independent damper is provided in the ink supply passage to impart an acoustic capacitance to the ink supply passage. Therefore, a reciprocal action is generated between the pressure chamber and the ink supply passage, whereby the ink replenishment operation can be stimulated. Consequently, the frequency of ink replenishment can be expanded by a factor of approximately √3, and the ink emission can be increased accordingly, without having to provide functional element in the ink supply passage.

Moreover, in the inkjet head according to the present invention, if the independent damper has an acoustic capacitance approximately equal to that of the meniscus of the nozzle, then the ink replenishment frequency can be increased due to the composition of the independent damper.

Furthermore, in the inkjet head according to the present invention, this can be achieved readily by setting the acoustic capacitance Cd of the independent damper within a range of 1 to √2 times the minimum value Cn of the acoustic capacitance of the meniscus.

Moreover, in the inkjet head according to the present invention, by constituting the nozzles in such a manner that the scale of change in the acoustic capacitance of the meniscus of the nozzle is less than a factor of 2, any change in the acoustic capacitance of the nozzles can be prevented from affecting the ink replenishment frequency.

Furthermore, in the inkjet head according to the present invention, by adopting a composition wherein the sectional area of the first ink supply passage is smaller than the sectional area of the pressure chamber and the independent damper, and the sectional area of the second ink supply passage is smaller than the sectional area of the ink chamber and the independent damper, it is possible to exclude the effects of the fluid resistance of the ink.

Moreover, in the inkjet head according to the present invention, when the independent damper has a structure wherein the ink chamber is covered by an elastic member, then a large acoustic capacitance can be achieved whilst maintaining a small chamber, and hence increase in the head size can be prevented.

Furthermore, in the inkjet head according to the present invention, by constituting the independent damper by means of a meniscus forming section, the acoustic capacitance of the nozzle meniscus can be achieved readily in the ink supply passage.

Moreover, in the inkjet head according to the present invention, when the energy generating section comprises a piezoelectric element, then the high-speed characteristics of a piezoelectric head can be utilized.

Further objects and modes of the present invention will become apparent from the following description of the embodiments and accompanying drawings.

BRIEF DESCRIPTION OF THE DRAWINGS

FIG. 16 is an explanatory diagram of the size of a piezoelectric member in a head according to one embodiment of the present invention;

FIG. 17 is an explanatory diagram of the size of a head according to one embodiment of the present invention;

DETAILED DESCRIPTION OF THE PREFERRED EMBODIMENTS

Figure 1:
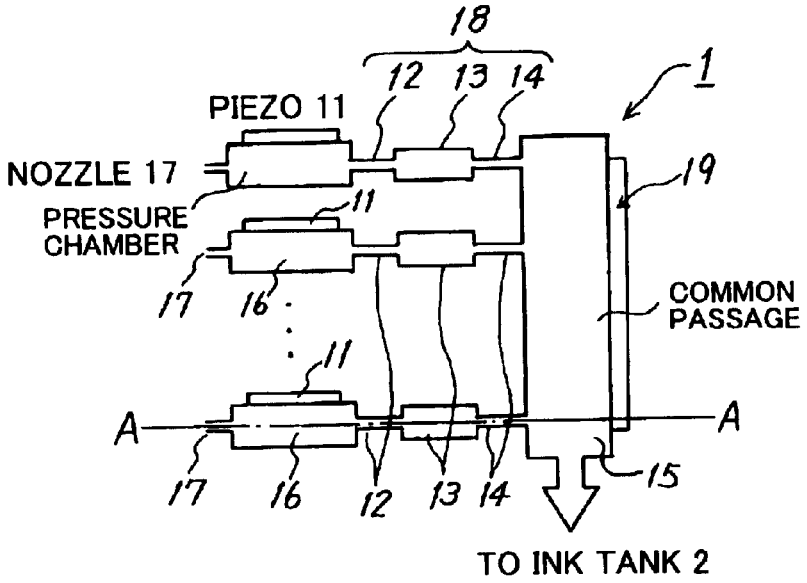
FIG. 1 is a compositional diagram of an inkjet head according to one embodiment of the present invention.
Figure 2:
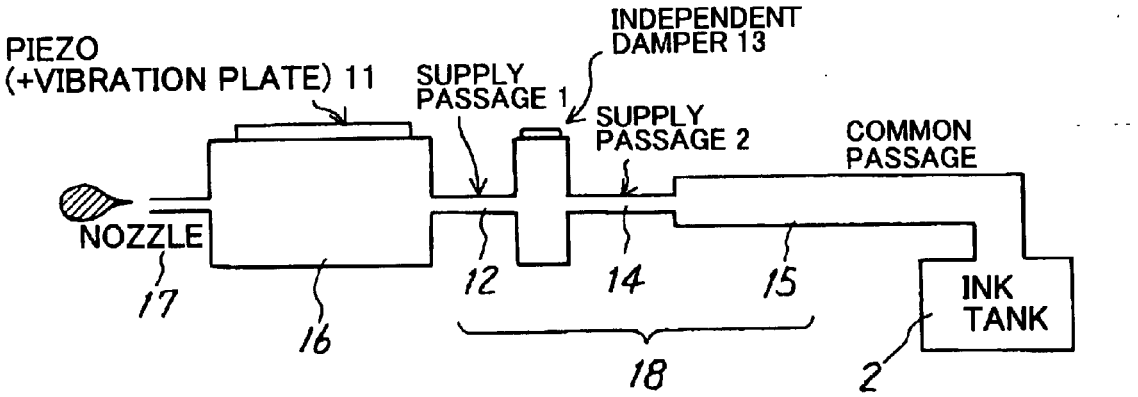
FIG. 2 is a sectional view of a head according to one embodiment of the present invention.
Figure 3:
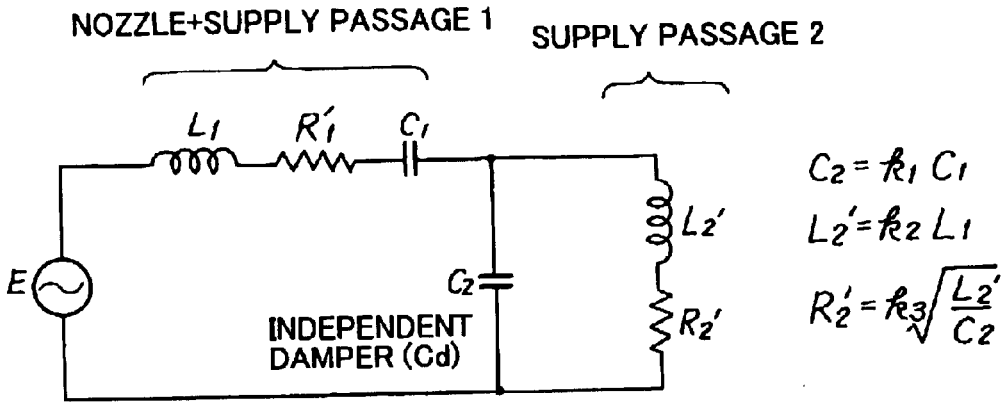
FIG. 3 is an approximate equivalent circuit in the case of ink replenishment of the head in FIG. 2.
Figure 4:
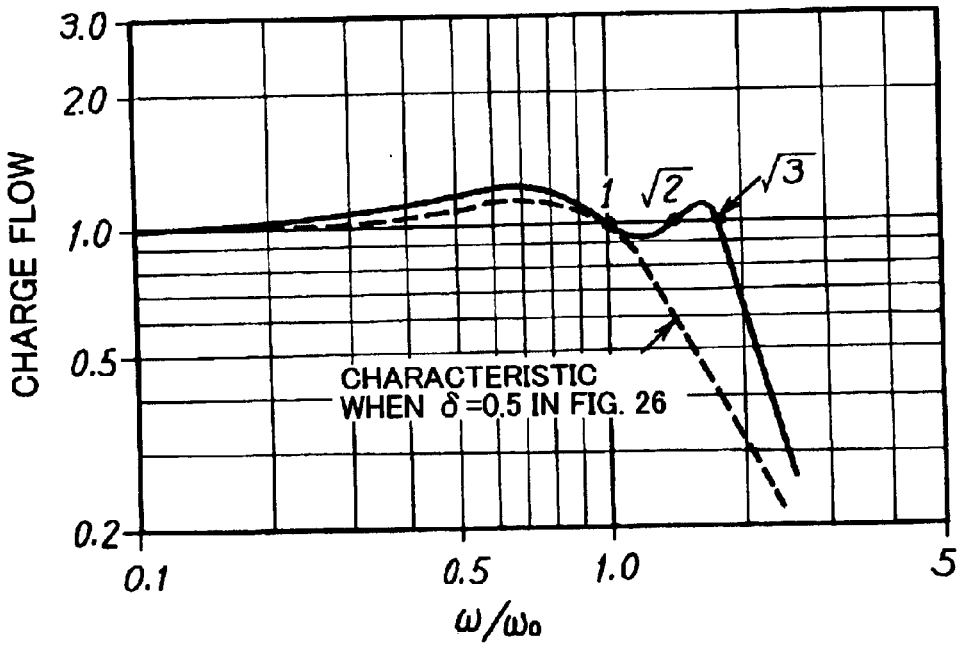
FIG. 4 is a frequency characteristics diagram of the circuit in FIG. 3.
Figure 5:
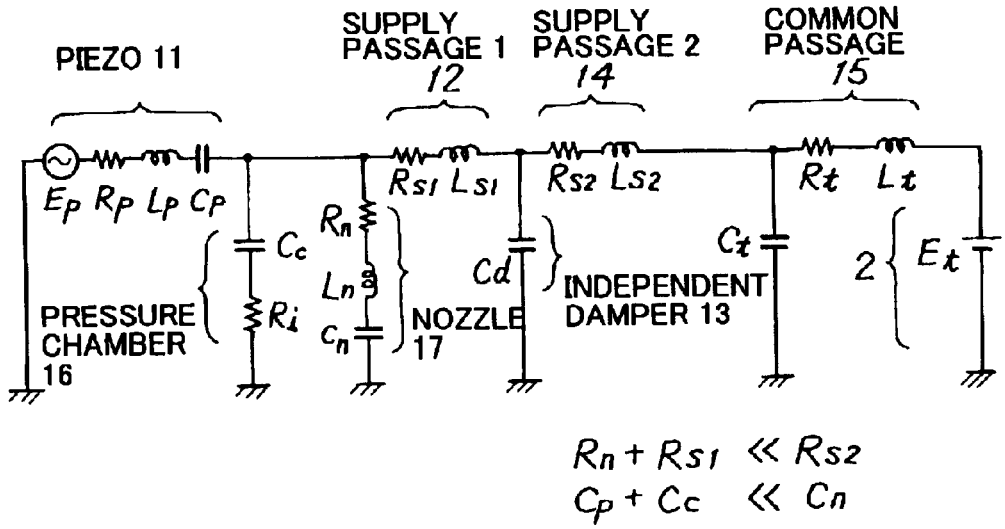
FIG. 5 is an acoustic equivalent circuit of the head in FIG. 2.

FIG. 1 is a plan view of a multi-nozzle inkjet head according to one embodiment of the present invention; FIG. 2 is a sectional view along A—A in FIG. 1; FIG. 3 is an acoustic equivalent diagram in the case of ink replenishment; FIG. 4 is a frequency characteristics diagram in the same case; and FIG. 5 is an acoustic equivalent diagram of the head in FIG. 1.

As shown in FIG. 1 and FIG. 2, in the head 1, ink is supplied from the ink tank 2 to the common ink passage 15. Moreover, in the head 1, the common ink passage 15, respective pressure chambers 16 and nozzles 17 are connected via ink supply passages 18. Each ink supply passage 18 is constituted by an independent damper 13 (acoustic capacitance element), a first supply passage 12 connecting the independent damper 13 and the pressure chamber 16, and a second supply passage 14 connecting the independent damper 13 with the common ink passage 15. A piezoelectric element 11, independent electrode, and vibrating plate are provided above the pressure chamber 16.

When a drive signal from a drive circuit is supplied to the independent electrode of the piezoelectric element 11 (there being one electrode corresponding to each nozzle), the vibrating plate is caused to distort towards the inside of the pressure chamber 16, as a result of the piezoelectric effect of the piezoelectric element 11, thereby causing ink to be expelled from the nozzle 17. This ink forms a dot on a print medium, whereby a desired image is created. After ink has been expelled from the nozzle 17, ink is replenished from the common ink passage 15 to the pressure chamber 16, via the ink supply passage 18. An acoustic capacitor section 19 is provided in the common ink passage 15 to absorb and alleviate pressure fluctuations in each of the pressure chambers 16.

The characteristic feature of the present invention lies in the fact that an independent damper 13 is provided in the ink supply passage 18 connecting the common ink passage 15 with each pressure chamber 16. This independent damper 13 is constituted by an acoustic capacitor element. Therefore, the acoustic equivalent circuit of the head in FIG. 1 and FIG. 2 will be as shown in FIG. 5. In other words, the circuit will be as the circuit illustrated in FIG. 23, but with the acoustic capacitance Cd of the independent damper 13 provided between the two supply passages 12 and 14.

Figure 23:
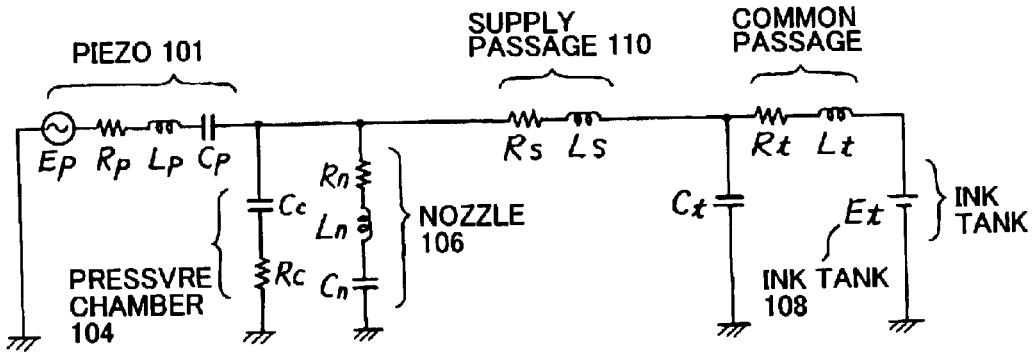
FIG. 23 PRIOR ART
FIG. 23 is an acoustic equivalent circuit of a multi-nozzle inkjet head according to the prior art.
Figure 24:
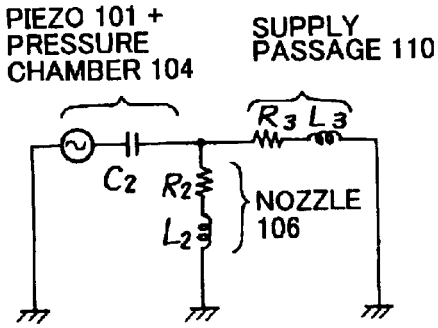
FIG. 24 PRIOR ART
FIG. 24 is an approximate acoustic circuit of a head according to the prior art, during ink emission.
Figure 25:
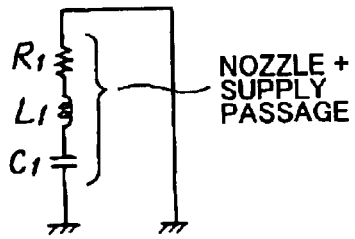
FIG. 25 PRIOR ART
FIG. 25 is an approximate acoustic equivalent circuit of a multi-nozzle inkjet head according to the prior art, during ink replenishment.

In a head of this composition, the independent damper 13 does not function during ink emission, and therefore the equivalent circuit in FIG. 5 is the same as the equivalent circuit in FIG. 23, and the approximate equivalent circuit during ink emission will be the same as that illustrated in FIG. 24. In other words, the independent damper 13 has no effect during ink emission. On the other hand, the approximate equivalent circuit during ink replenishment will be as the circuit in FIG. 25, but with the acoustic capacitance Cd (C2) of the independent damper 13 provided between the two supply passages 12, 14, as illustrated in FIG. 3.

The approximate equivalent circuit in FIG. 3 corresponds to a circuit having a capacitor connected in parallel to the input side, and is able to increase the operating frequency. In other words, in the field of analogue telephones, it is commonly known to connect a capacitor in parallel to the input side, in order to expand the transmission frequency band of the second-order delay created by the LCR in FIG. 25 (see, for example, Hayakawa & Furukawa: Onkyou-Shindou-Ron (Theories of Acoustic Vibration in its English translation), pp. 196–197 published by Maruzen).

Figure 26:
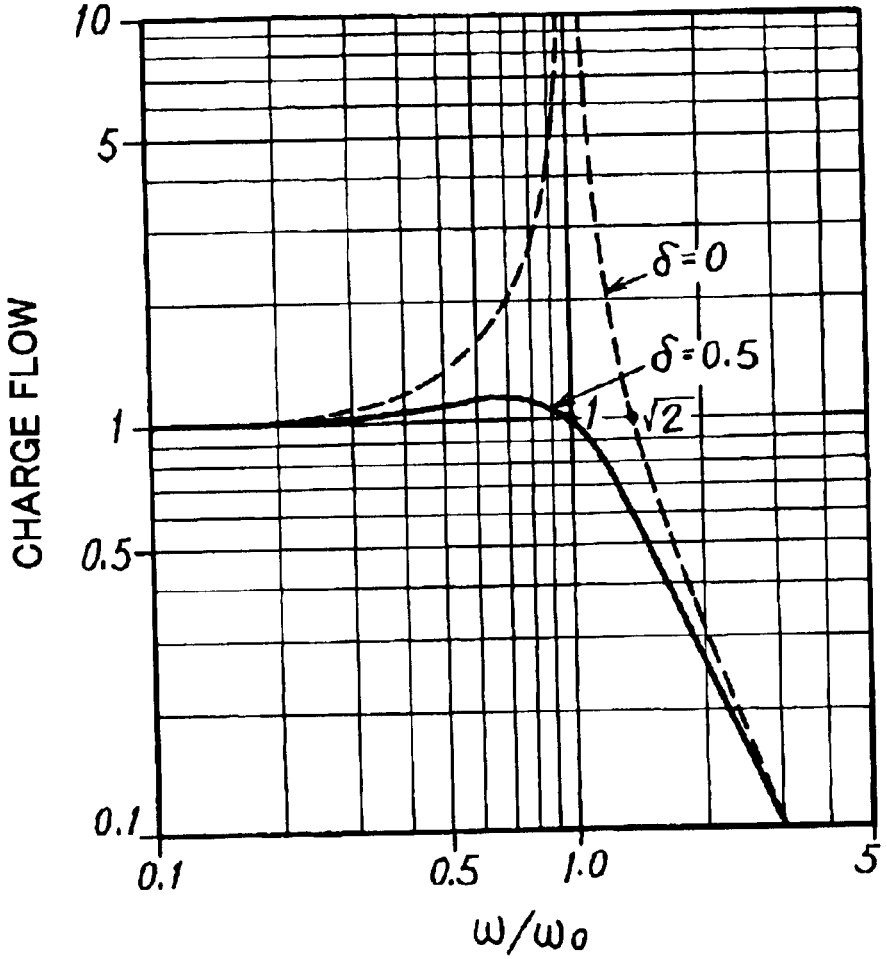
FIG. 26 PRIOR ART
FIG. 26 is a frequency characteristics chart of a head according to the prior art, during ink replenishment.

According to this method, in the circuit in FIG. 3, by selecting the relationships: C1=C2, L2'=L1, R2'=√(L2'/C2), R1'=0, the current flow, compared to the LCR second-order delay indicated by the broken line (illustrated for a case of δ=0.5 in FIG. 26), can increases the average frequency characteristics by a factor of √3 without reducing the sensitivity slightly.

By adopting this theory in an inkjet head, the ink replenishment speed, in other words, the intrinsic number of vibrations, can be increased by a factor of √3. Returning to the equivalent circuit of the head in FIG. 3, the application of the head in the aforementioned conditions will now be studied.

In the equivalent circuit of the head in FIG. 3, referring to FIG. 5, C2 is the acoustic capacitance Cd of the independent damper 13, and C1 is the acoustic capacitance Cn of the nozzle 17. Therefore, according to the first condition of the aforementioned theory, the acoustic capacitance Cd of the independent damper 13 should be equal to the acoustic capacitance Cn of the nozzle 17.

Moreover, since L1 is the inertance of the nozzle 17 and the first supply passage 12, then according to the second condition of the aforementioned theory, the inertance L2' (Ls2) of the second supply passage 14 should be equal to (Ln+Ls1).

Moreover, according to the third condition, the acoustic resistance R2' of the second supply passage 14 should be equal to √(L2'/Cd). According to the fourth condition, R1', the sum of the acoustic resistances of the nozzle 17 and the first supply passage 12 (Rn+Rs1) should be zero.

By satisfying these conditions, a frequency band which is larger by a factor of √3 can be obtained, as described above, and hence the ink replenishment speed can be increased. However, it is difficult to achieve these conditions in the head structure (the structure of the nozzles, pressure chambers, and supply passages), and compositions suitable for achieving these conditions have been investigated.

Firstly, the acoustic capacitance Cn of the nozzle 17 is the acoustic capacitance of the ink meniscus, which is not linear, and has a value at least two orders of ten greater than the acoustic capacitance of the piezoelectric element 11. Therefore, conventional acoustic circuit analysis for ink emission (linear analysis) recognizes this situation as a short-circuit, and consequently, for the ink replenishment operation, it has been necessary to adopt non-linear analysis using methods other than acoustic circuits, to provide a first-order delay approximation (for example, U.S. Pat. No. 4,443,807).

However, analysis carried out by the present inventors, and others, has revealed a method for significantly reducing the non-linearity of the acoustic capacitance Cn of the aforementioned meniscus. By regarding the non-linearity of the acoustic capacitance Cd of the meniscus as element value fluctuation and maximizing the tolerable fluctuation of the element values, it is possible to calculate optimum values for the circuit elements in FIG. 3 (FIG. 5) in a linear fashion. In other words, it is possible to achieve the first condition in a head structure. This is now described with reference to FIG. 6 to FIG. 9.

Figure 6:
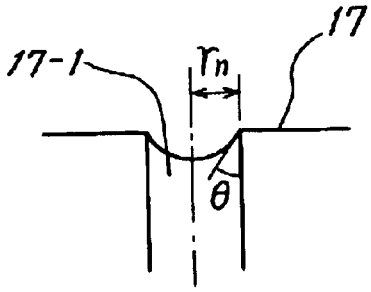
FIG. 6 is an explanatory diagram of the meniscus in the head in FIG. 2.
Figure 7:
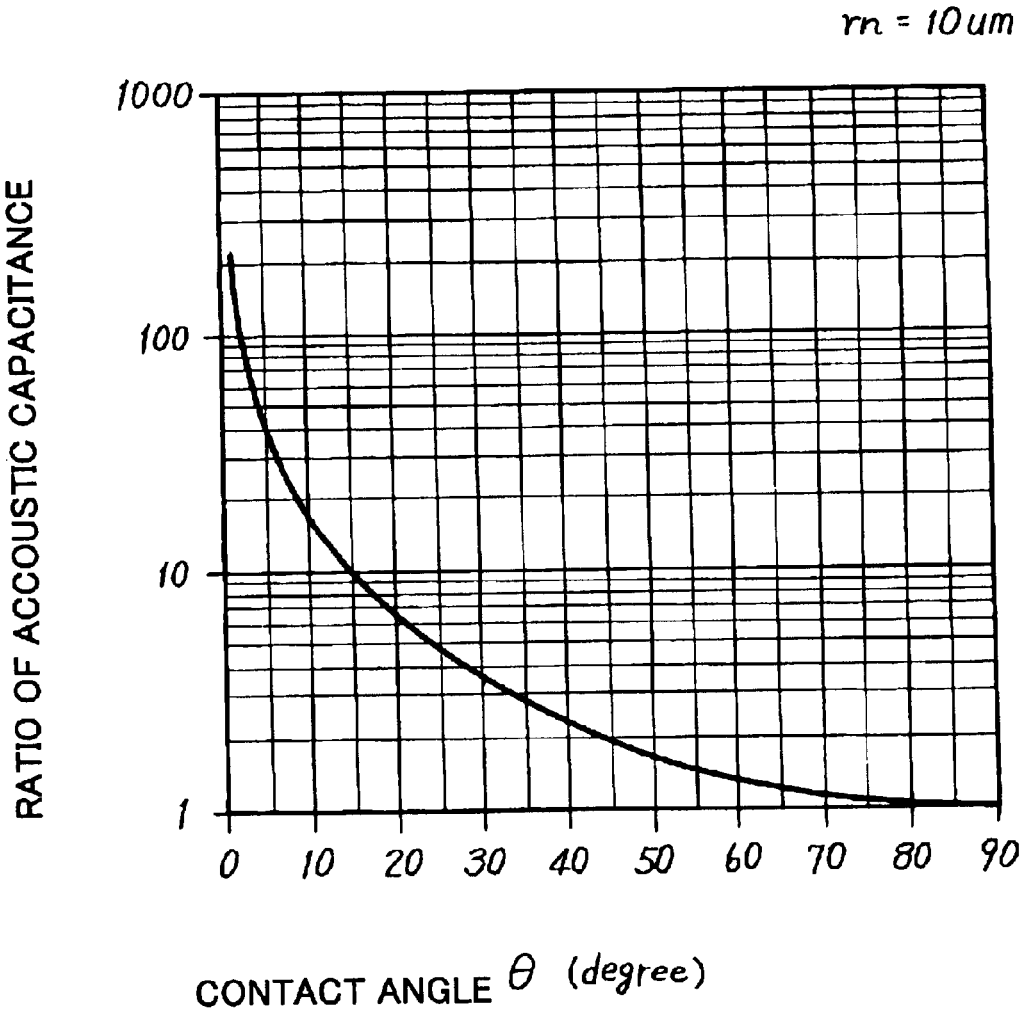
FIG. 7 is a graph of the relationship between the meniscus contact angle and the acoustic capacitance.

FIG. 6 shows the state of the meniscus 17-1 at the nozzle 17, wherein rn is the diameter of the nozzle 17 and Θ indicates the angle of contact. FIG. 7 shows the ratio of the acoustic capacitance at each contact angle, in a graph where the horizontal axis represents the contact angle, and the vertical axis represents the acoustic capacitance with respect to a capacitance value of "1" when the contact angle Θ is 90°. FIG. 7 shows calculated values for a case where the aforementioned radius rn of the nozzle 17 is 10 μm. From FIG. 7, it can be seen that the acoustic capacitance of the nozzle varies significantly in a non-linear fashion.

Figure 8:
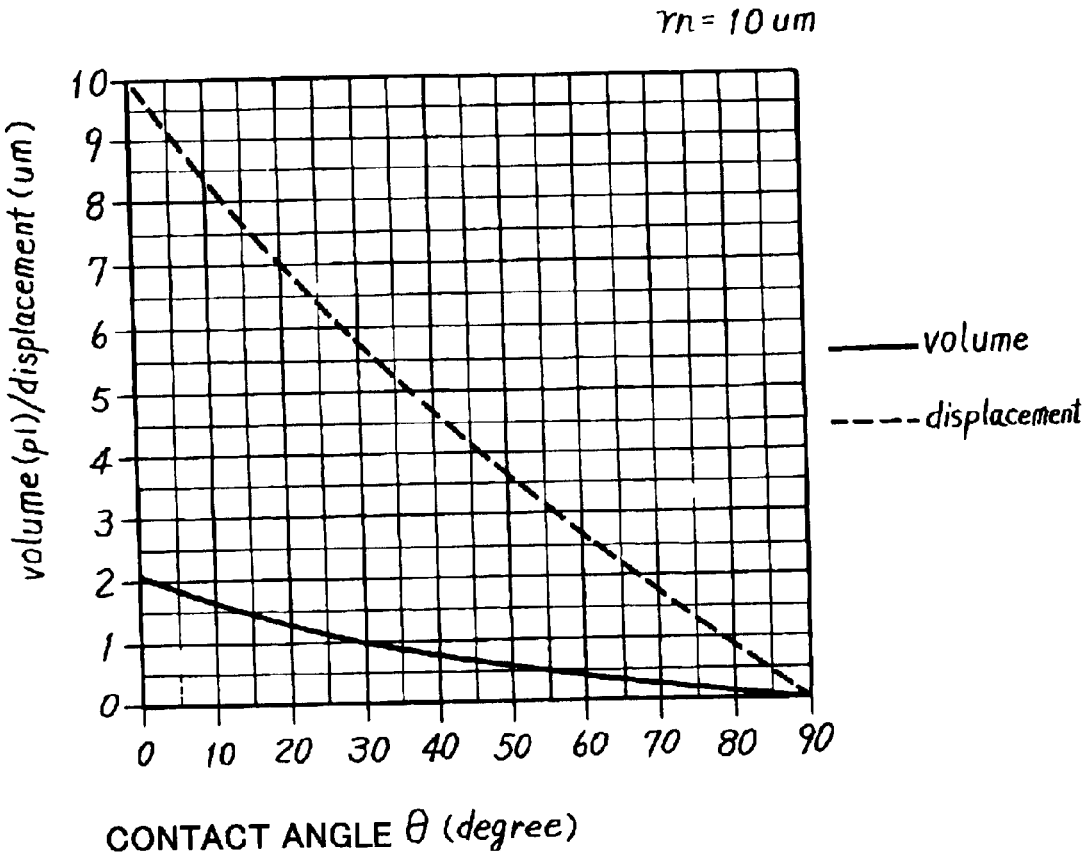
FIG. 8 is a graph of the relationship between the meniscus contact angle and volume displacement and position.

FIG. 8 shows the meniscus position and meniscus volume displacement at respective contact angles. The meniscus position and volume displacement are zero when the contact angle is 90°, and volume displacement increases as the meniscus withdraws. Moreover, in FIG. 8, the radius rn of the aforementioned nozzle 17 is 10 μm, and the calculated values relate to a case of injecting an ink particle of 2 μm.

In a standard design, the maximum appropriate value for the withdrawal of the meniscus during replenishment of the ink is the amount of withdrawal of the meniscus when the volume displacement of the meniscus is a displacement of approximately 30% of the volume of the ink particle. In a conventional 600 dpi head, the design involves an ink particle of approximately 20 pl being injected from a nozzle of diameter approximately 30 μm, and the range of variation in the contact angle when the meniscus withdraws is a wide range between 90° and 20°. Consequently, as the characteristics in FIG. 8 indicate, the maximum change in the acoustic capacitance of the meniscus is a factor of 6, approximately, based on the reference value when the contact angle is 90°.

However, as FIG. 8 also illustrates, in the case of a nozzle having a large diameter with respect to the injected particle volume, in the range wherein said volume displacement is 30 percent, the change in acoustic capacitance will narrow to a range between 90° and 45°. From FIG. 7, the change in acoustic capacitance in this contact angle range is less than a factor of 2 with respect to the standard value when the contact angle is 90° (this being taken as a minimum value). In this way, by designing a head which injects an ink particle of 2 pl from a nozzle 17 of a relatively large diameter of 20 μm, the volume displacement after withdrawal of the meniscus is reduced, and the range of change of the contact angle is reduced to a range of 90° to 45°, meaning that the change in acoustic capacitance is reduced to a factor of less than 2, which is approximately one third of the value in the prior art.

Figure 9:
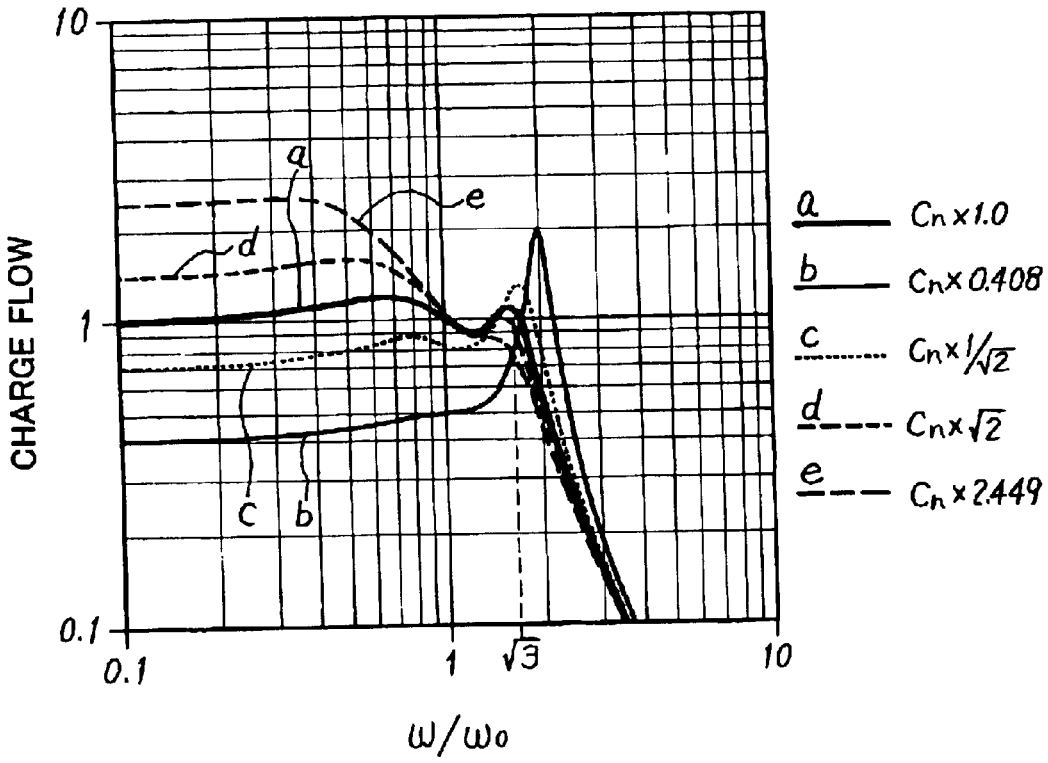
FIG. 9 is a frequency characteristics chart of the acoustic capacitance of the meniscus of FIG. 7.

Hitherto, it has been possible to regard the non-linearity of the acoustic capacitance of the meniscus as element value variation, by reducing the range of variation. Various element designs have been made which maximize the tolerable variation in the element values. FIG. 9 is a frequency characteristics chart of the head charge flow with respect the acoustic capacitance C1 (Cd) of the independent damper 13. In other words, it shows the calculated frequency characteristics in respective cases where the acoustic capacitance of the independent damper 13 is set to 1.0 times the acoustic capacitance Cn of the meniscus (case a), 0.408 times same (case b), 1/√2 times (0.707 times) same (case c), √2 times (1.414 times) same (case d), and 2.449 times same (case e).

From FIG. 9, when the acoustic capacitance is in less than two times greater, in other words, in the range from case c to case d, then all of the change in the charge flow comes within the 30 percent range, compared to case a, and the charge flow at the cut-off frequency ($\omega/\omega 0=\sqrt{3}$) shows virtually no change. Ink replenishment is possible at this cut-off frequency. Consequently, when the maximum acoustic capacitance of the meniscus 17-1 is taken as kb·Cn, then in the range where the aforementioned acoustic capacitance is less than two times greater, in other words, the range of kb<=2, the relationship kb/√2Cn<=Cd<=√2Cn is established.

Here, if it is assumed that Cd=k1·Cn, then from the aforementioned equation, the relationship kb/√2≦k1≦√2 is established. Since kb≦2, then 1≦k1≦√2. Due to conditions of this kind, it is possible to expand the range of the ink replenishment frequency.

Secondly, with variation in the ambient temperature (in a range between 0° and 40°), the viscosity of the ink changes in a range of between approximately 0.5 and 2 times the viscosity at normal temperature. Therefore, the condition (equal to √(L2'/Cd)) of the circuit element R2' in the aforementioned FIG. 3 (acoustic resistance of the second supply passage 14) is only established at a particular temperature. The frequency characteristics change with the variation in R2' caused by the change in ink viscosity. We shall now investigate the effect of this on ink replenishment.

Figure 10:
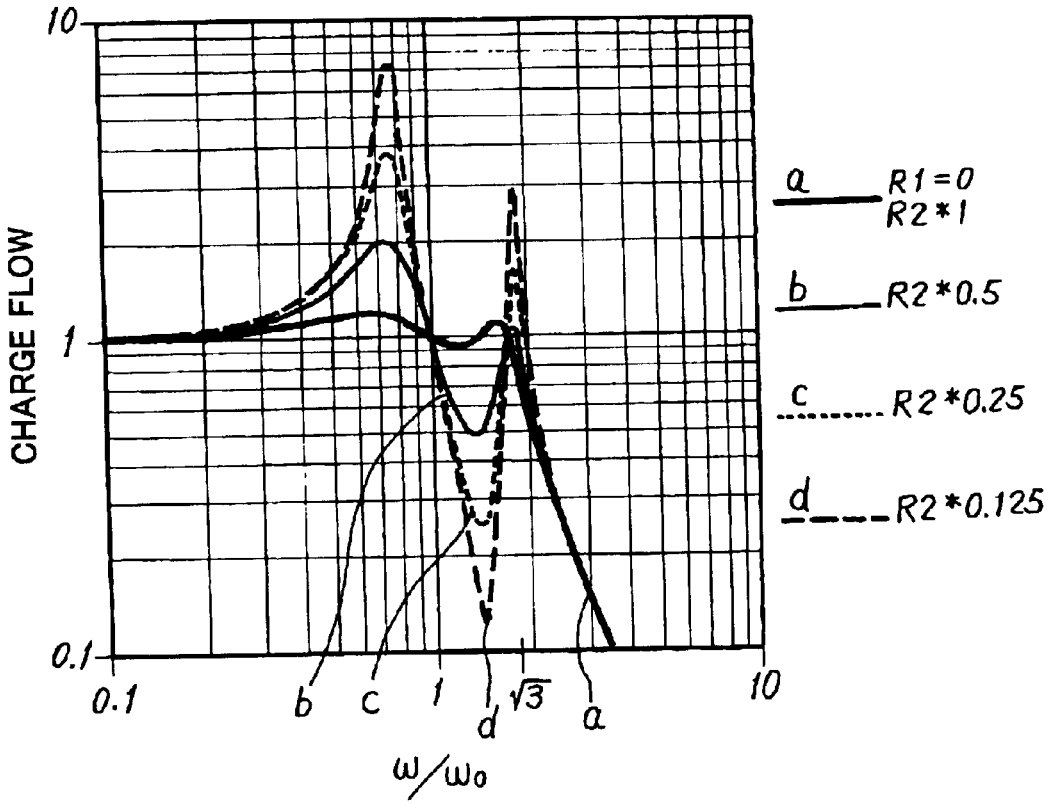
FIG. 10 is a frequency characteristics chart of the acoustic resistance of the head in FIG. 2.

FIG. 10 shows the results of a simulation of the frequency characteristics of charge flow in the equivalent circuit in FIG. 3, in respective cases where the circuit element R2' is taken as one times, 0.5 times, 0.25 times, and 0.125 times, the value of a standard value R2. The circuit element R1 is set to "0" in accordance with the fourth condition introduced above.

From FIG. 10, it is evident that the frequency characteristics of the charge flow vary greatly with change in R2'. However, in each of the cases a, b, c and d, there is virtually no change in the charge flow at the cut-off frequency ($\omega/\omega 0=\sqrt{3}$). Therefore, ink replenishment is possible at the cut-off frequency. Consequently, in the relationship R2'=k3√(L2'/C2), it is not necessary that k3=1, but rather, it is also possible that 0<k3≦1. Moreover, from the results of FIG. 10, desirably, 0.5≦k3≦1, as the variation in charge flow will be small.

Thirdly, in the aforementioned condition 4, the value of the circuit element R1' in FIG. 3 is zero. However, in an inkjet head, the circuit element R1' corresponds to the fluid resistance of the nozzle and the first supply passage, and this cannot be reduced to zero. We shall now investigate the level of values of this acoustic resistance R1' which still permit the aforementioned broadening of the operating frequency.

Figure 11:
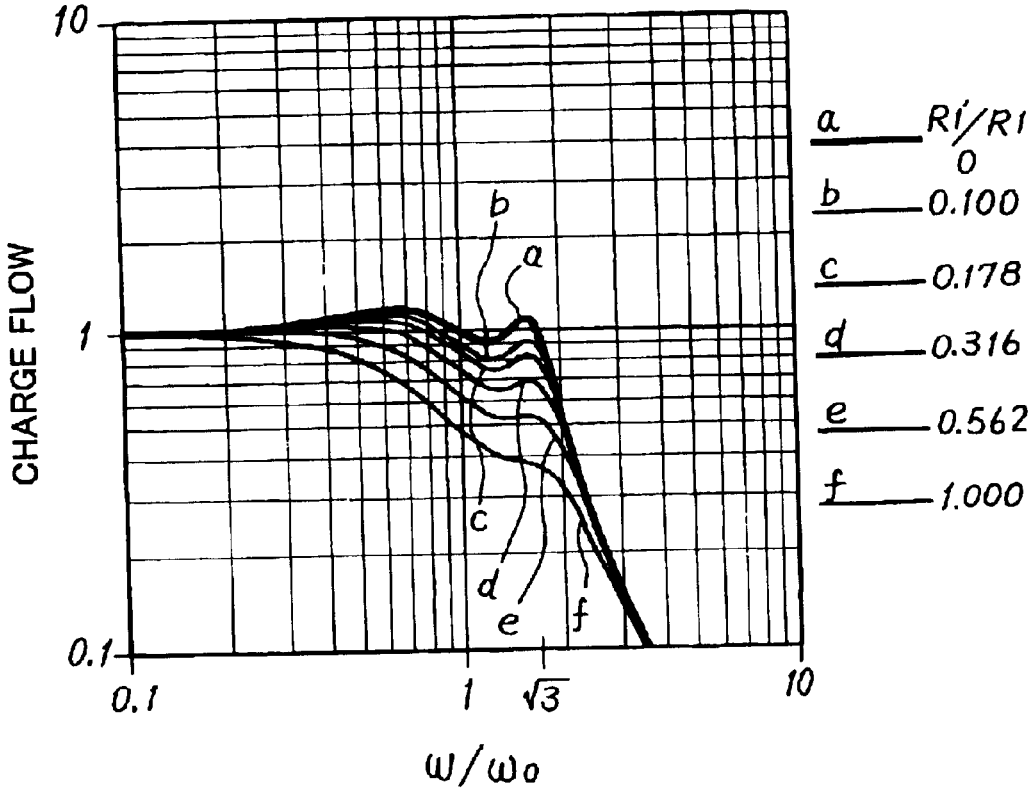
FIG. 11 is a frequency characteristics chart of the acoustic resistance ratio of the head in FIG. 2.

FIG. 11 shows the results of simulations of the frequency characteristics of charge flow in the equivalent circuit in FIG. 3, in respective cases where the circuit element R1' has a value of 0 times, 0.100 times, 0.178 times, 0.316 times, 0.562 times, and 1.000 times the standard value R1.

From FIG. 11, it is evident that the frequency characteristics of the charge flow vary with change in R1', and the value of the charge flow at the cut-off frequency ($\omega/\omega 0=\sqrt{3}$) becomes smaller, the larger the value of R1'/R1. However, if R1'/R1 is less than 0.1 (case b), then the reduction in the charge flow will be less than approximately 7 percent. In this range, ink replenishment is sufficiently possible at the cut-off frequency.

Accordingly, in the relationship R1'=k4·(Rn+Rs1) (see FIG. 5), it is not necessary that k4 be reduced to zero, and the range of 0<k4≦0.1 is possible. In other words, it is possible to have an acoustic resistance within said range in the nozzle 17 and first supply passage. Therefore, even if this acoustic resistance is not zero, due to the dimensions of the nozzle and supply passage, broadening of the operating frequency range can still be achieved. Moreover, when the damping factor ∂ is set to "0.5", as described in relation to FIG. 25 previously, then optimum emission characteristics are obtained, and by substituting this into the aforementioned calculation equation for the damping factor, the relationship (Rn+Rs1)=k4·√(Ln+Lc +Ls1)/Cn is obtained, and hence the dimensions of the nozzle and the first supply passage can be set by means of this equation.

Figure 12:
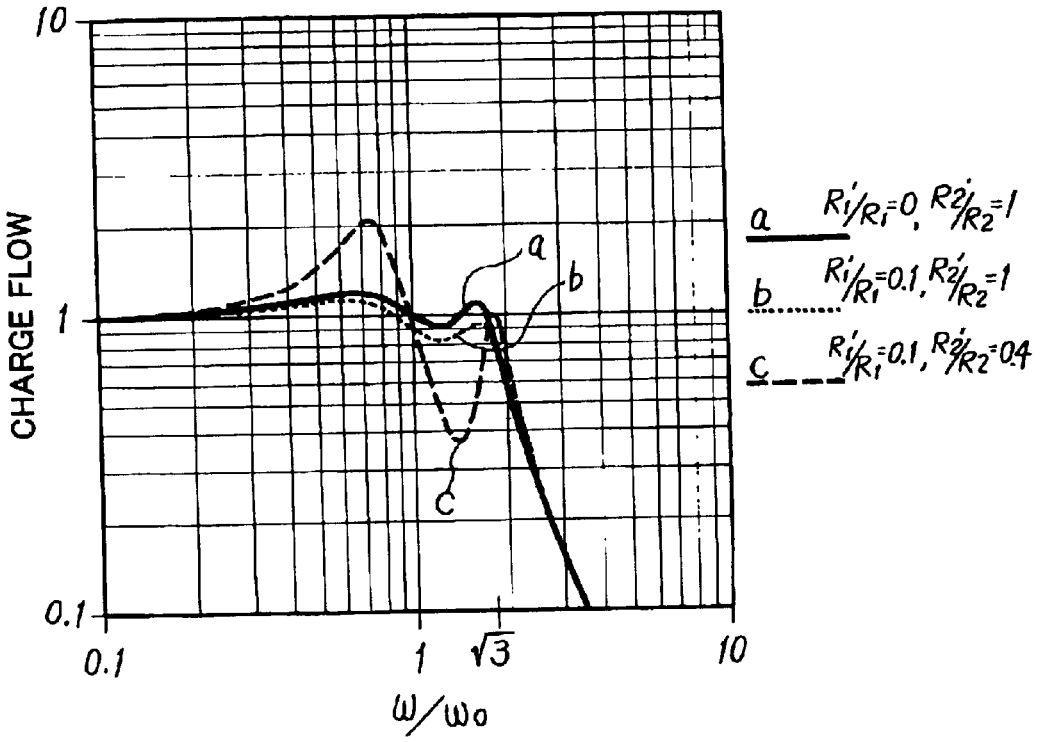
FIG. 12 is a frequency characteristics chart of one embodiment of the present invention.

FIG. 12 shows the results of simulation of the frequency characteristics of the charge flow in the equivalent circuit in FIG. 3, in a case where the aforementioned conditions are combined. In the diagram, the previously stated acoustic capacitance condition for the first nozzle is satisfied at all times. a indicates ideal conditions wherein k4 (=R1'/R1)=0, k3 (=R2'/R2)=1; b indicates conditions wherein k4 (=R1'/R1)=0.1, k3 (=R2'/R2)=1; and c indicates conditions wherein k4 (=R1'/R1)=0.1, k3 (=R2'/R2)=0.4.

In case b, there is virtually no variation from the ideal conditions in case a, and therefore, it is possible to achieve a broad range of operating frequency for ink replenishment, even if the nozzle and supply passage have fluid resistance. Moreover, even in case c, where the temperature variation of ink viscosity is taken into account in order to facilitate design, the charge flow at the cut-off frequency ($\omega/\omega 0=\sqrt{3}$) shows virtually no change from the ideal conditions in case a. Therefore, ink replenishment is possible at this cut-off frequency.

For example, in a head which injects 2.0 pl ink particles as described hereinafter, the volume of the ink particle at the cut-off frequency ($\omega/\omega 0=\sqrt{3}$) of 59.8 kHz is 1.8 pl, which is 90 percent of the value of 2.0 pl at low frequency. Consequently, since the range of variation of the ink particles is small, printing across a broader range of operating frequencies is satisfactorily possible.

Figure 13:
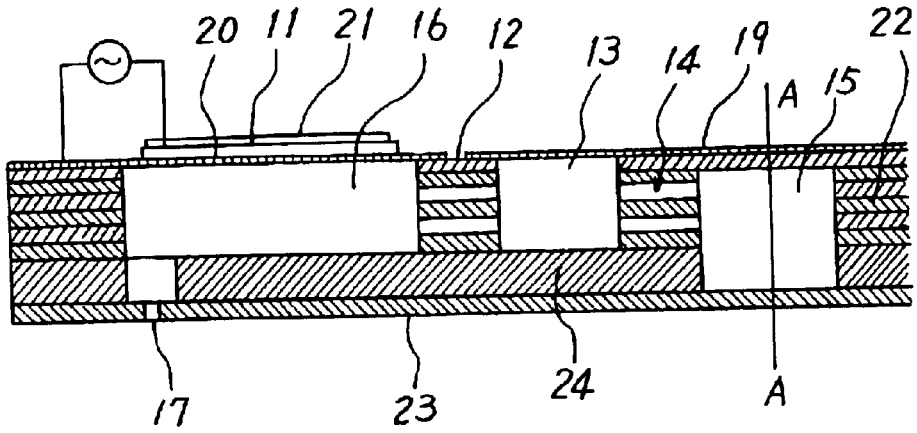
FIG. 13 is a sectional view of a head according to one embodiment of the present invention.
Figure 14:
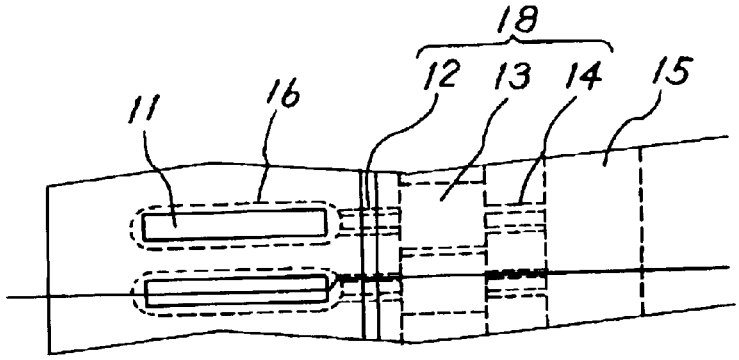
FIG. 14 is a plan view of a head according to one embodiment of the present invention.
Figure 15:
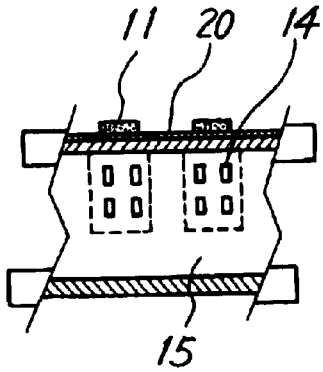
FIG. 15 is a sectional view along A-A of a head according to one embodiment of the present invention.

Next, an embodiment of this head structure will be described. FIG. 13 is a sectional view of a multi-nozzle inkjet head (hereinafter, called "head"), and FIG. 14 is a plan view of the head in FIG. 13, and FIG. 15 is a sectional view along A—A of the head in FIG. 13. As shown in FIG. 14, the head 1 has a plurality of nozzles. In other words, a plurality of pressure chambers 16 and a plurality of piezoelectric elements 11 are provided with respect to the common ink passage 15, via ink supply passages 18. As shown in FIG. 13, a bimorph actuator is used which comprises a piezoelectric element 11 laminated onto a vibrating plate 20 as a drive element. To fabricate this head, a plurality of individual electrodes 21 are formed by sputtering onto an MgO substrate (not illustrated), and the piezoelectric elements 11 are then laminated thereon to a thickness of several μm, and patterning is performed. Subsequently, metal (Cr, or the like) forming the common electrode and vibrating plate 20 is formed to a thickness of several μm across the entire surface, thereby creating a bimorph structure.

A separately prepared pressure chamber forming material (dry film resist) 22 and nozzle forming members 23, 24 are then aligned with a position corresponding to the individual electrode 20 of the bimorph structure and bonded thereto. Thereupon, the MgO substrate is etched to complete a multi-nozzle head plate 1.

In this head 1, the pressure chamber 16, first ink supply passage 12, independent damper chamber 13, second ink supply passage 14, and common ink passage 15 are formed on a dry film resist 22. The operation of the head 1 involves supplying ink from the ink tank 2 in FIG. 1 to the head 1, and then supplying the ink inside the head 1 to the respective pressure chambers 16 and nozzles 17 by means of the common ink passage 15 and the ink supply passages 18. The vibrating plate 20 is earthed to a ground, and when a drive signal is supplied to the individual electrode (one electrode corresponding to each respective nozzle) 21 from a drive circuit, the vibrating plate 20 is caused to distort towards the inside of the pressure chamber 16, due to the piezoelectric effect of the piezoelectric element 11, thereby causing ink to be expelled from the nozzle 17. This ink forms a dot on a print medium, whereby a desired image is created.

Figures 18, 19, 20:
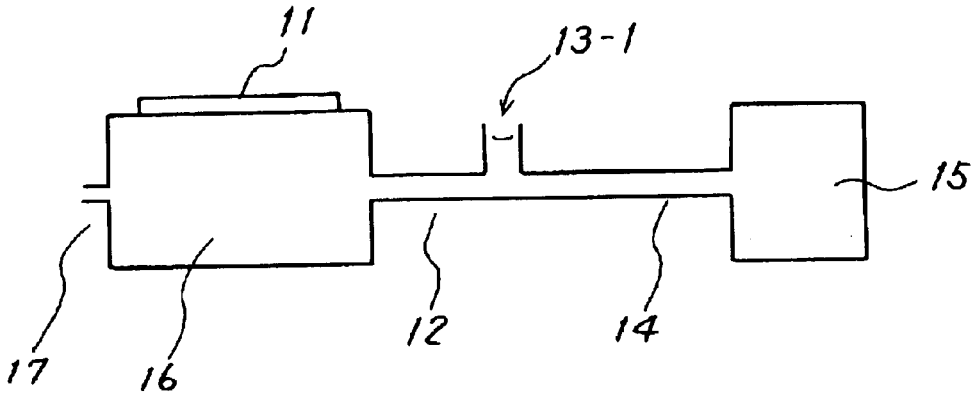
FIG. 18 is an explanatory diagram of the size of an independent damper of a head according to one embodiment of the present invention.
FIG. 19 is an explanatory diagram of the properties of ink used in a head according to one embodiment of the present invention.
FIG. 20 is a sectional view of a head according to a further embodiment of the present invention.
Figure 21:
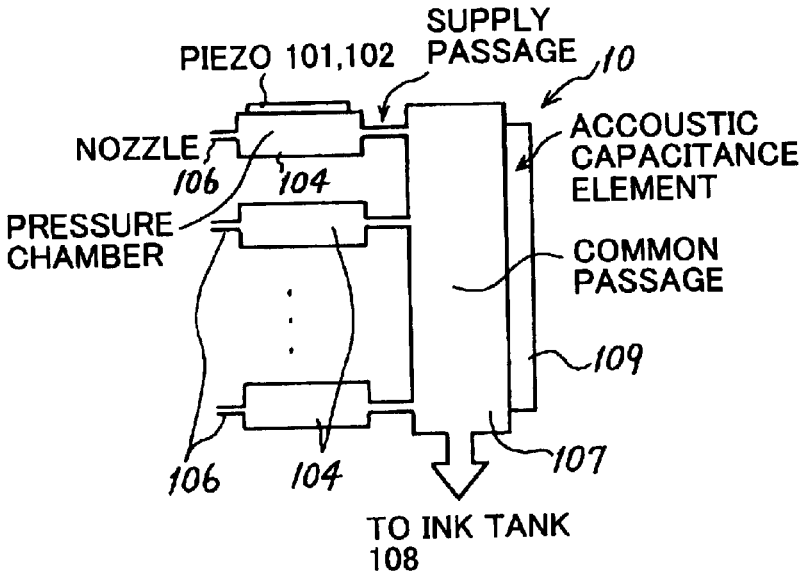
FIG. 21 PRIOR ART
FIG. 21 is a compositional diagram of a multi-nozzle inkjet head according to the prior art.
Figure 22:
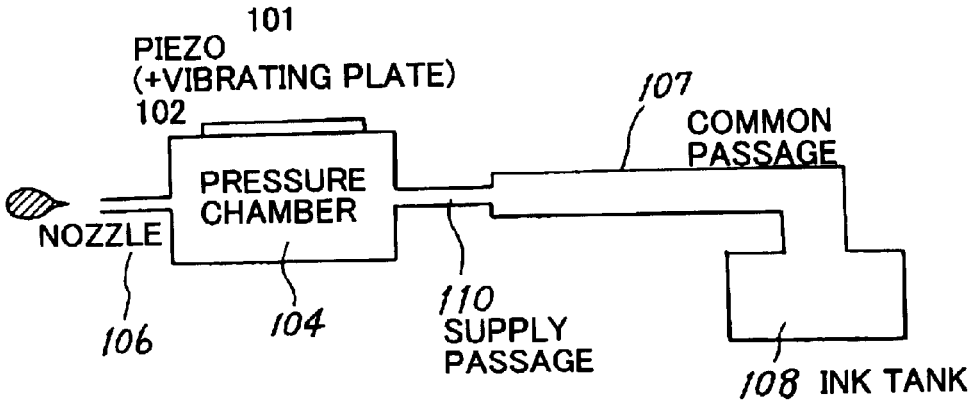
FIG. 22 PRIOR ART
FIG. 22 is a sectional view of a head according to the prior art.

Moreover, the individual damper chamber 13 is covered by an elastic film 19 to impart a prescribed acoustic capacitance thereto. More specifically, the independent damper 13 needs to have a similar acoustic capacitance to the acoustic capacitance of the meniscus, but this acoustic capacitance of the meniscus is very large. Therefore, the independent damper 13 should be formed to a very large size, but in this case, the head 1 would increase in size, which is not desirable. Here, in order impart a large acoustic capacitance whilst maintaining a small volume, an elastic film 19 is used. Polyimide (PI), for example, is suitable for this film. FIG. 16 to FIG. 18 show the dimensions of an embodiment of a head according to the present invention, this being a piezoelectric type head of 150 dpi resolution. As shown in FIG. 16, the piezoelectric member 11 uses PZT of width 100 μm, length 700 ∞m and thickness 2 μm. The vibrating plate 20 uses Cr of width 100 μm, length 700 μm and thickness 1.5 μm.

As shown in FIG. 17, the nozzle diameter is 20 μm, and the first ink supply passage 12 has a width of 71 μm, length of 761 μm, and depth of 73 μm. The second ink supply passage 14 has a width of 16 μm, length of 34 μm, and depth of 17 μm The pressure chamber 16 has a width of 100 μm, length of 700 μm, and depth of 123 μm.

As shown in FIG. 18, the independent damper 13 has a width of 100 μm, length of 268 μm, and depth of 123 μm which is the same as the pressure chamber, and moreover, it is covered with 3.5 μm thick polyimide 19. Ink having the characteristics in FIG. 19 is used in the head 1 of this composition, and as shown in FIG. 17, performance of 10.0V applied voltage, 2.0 pl ink particle volume and 8.0 m/s particle propulsion speed, was obtained.

When calculated using a commonly known acoustic calculation formula, the following values are obtained for the respective circuit elements in FIG. 3: Cd=1.18e-19, C1=8.36e-20–16.72e-20, L1=2.54e8, R1'=8.07e12, C2=1.18e-19, L2'=1.27e8, R2'=3.38e13.

Under these conditions, the operating frequency range for the circuit in FIG. 3 was calculated to be 59.8 KHz, thus confirming a 1.73 times speed improvement compared to the prior art.

FIG. 20 shows the composition of an independent damper 13 according to a further embodiment of the present invention. This independent damper 13 is constituted by a meniscus forming section 13-1 of the same shape as the nozzle. By this means, it is possible to achieve the same acoustic capacitance as the nozzle, directly. However, there is a possibility of blocking.

Furthermore, this head has been described with respect to an on-demand type head, but it may also be applied to a continuous type head which injects ink continuously. Moreover, here, water-based ink has been used, but the head may also be applied similarly to oil-based ink. In addition, it can also be used with solid inks which solidify at room temperature. In the case of solid ink, the ink passages and pressure chambers are heated to a uniform temperature, and therefore, the ink viscosity is uniform, regardless of the ambient temperature. Therefore, it is not necessary to take account of changes in the viscosity of the ink, and hence the design of the respective element values becomes easier.

Moreover, this head is not limited to piezoelectric type heads, and can also be applied to a head using thermal elements.

Above, the present invention was described by means of an embodiment, but various modifications are possible within the scope of the claims of the present invention, and such modifications are not excluded from the claims of the invention.

INDUSTRIAL APPLICABILITY

In the present invention, since independent dampers are provided in ink supply passages to impart an acoustic capacitance to the ink supply passage, a reciprocal action is generated between the pressure chamber and the ink supply passage, whereby the ink replenishment operation can be stimulated. Consequently, the frequency of ink replenishment can be increased by approximately √3 and the ink emission speed can be increased accordingly, without having to provide functional elements in the ink supply passage.

What is claimed is:

1. An inkjet head for jetting ink from nozzles, comprising:

pressure chambers communicating with said nozzles;

energy generating sections for imparting ink jet energy to said pressure chambers; and supply passages for supplying ink from an ink chamber to said pressure chambers, wherein each of said supply passages comprises:

an independent damper;

a first ink supply passage connecting said independent damper with said pressure chamber; and a second ink supply passage connecting said independent damper with said ink chamber, wherein said independent damper has an acoustic capacitance approximately equal to that of the meniscus of said nozzle.

2. The inkjet head according to claim 1, wherein the acoustic capacitance 'Cd' of said independent damper is set within a range of 1 to √2 times the minimum value 'Cn' of the acoustic capacitance of said meniscus.

3. The inkjet head according to claim 1, wherein said nozzles are constituted in such a manner that the scale of change in the acoustic capacitance of the meniscus of said nozzle is less than a factor of 2.

4. The inkjet head according to claim 1, wherein the sectional area of said first ink supply passage is smaller than the sectional area of said pressure chamber and said independent damper; and the sectional area of said second ink supply passage is smaller than the sectional area of said ink chamber and said independent damper.

5. The inkjet head according to claim 1, wherein said energy generating section comprises a piezoelectric element.

6. An inkjet head for jetting ink from nozzles, comprising:

pressure chambers communicating with said nozzles;

energy generating sections for imparting ink let energy to said pressure chambers; and supply passages for supplying ink from an ink chamber to said pressure chambers, wherein each of said supply passages comprises:

an independent damper;

a first ink supply passage connecting said independent damper with said pressure chamber; and a second ink supply passage connecting said independent damper with said ink chamber, wherein said independent damper has a structure wherein the ink chamber is covered by an elastic member.

7. The inkjet head according to claim 6, wherein the sectional area of said first ink supply passage is smaller than the sectional area of said pressure chamber and said independent damper; and the sectional area of said second ink supply passage is smaller than the sectional area of said ink chamber and said independent damper.

8. The inkjet head according to claim 6, wherein said energy generating section comprises a piezoelectric element.

* * * * *